United States Patent [19]

Lagneau

[11] Patent Number: 4,917,545

[45] Date of Patent: Apr. 17, 1990

[54] APPARATUS FOR CONTROLLING MATERIAL FLOW

[76] Inventor: Jean H. Lagneau, 1 Grande Rue, Tremblay les Villages, 28170 Chateauneuf en Thymerais, France

[21] Appl. No.: 30,841

[22] Filed: Mar. 27, 1987

[30] Foreign Application Priority Data

Apr. 4, 1986 [FR] France ..... 86 04847

[51] Int. Cl.[4] ..... B65G 53/02

[52] U.S. Cl. ..... 406/86; 406/88; 406/137

[58] Field of Search ..... 406/88, 86, 108, 117, 406/181, 89, 90, 91, 137, 70, 138, 120; 222/460, 462, 564, 630, 637

[56] References Cited

U.S. PATENT DOCUMENTS

| | | | |
|---|---|---|---|
| 1,307,365 | 6/1919 | Kinyon | 406/86 X |
| 2,882,097 | 4/1959 | Hamren | 406/88 |
| 3,797,707 | 3/1974 | Jenike et al. | 406/137 |
| 4,411,674 | 10/1983 | Forgac | 406/88 X |
| 4,504,177 | 3/1985 | Lagneau | 406/88 X |
| 4,508,474 | 4/1985 | Frederick | 406/137 X |
| 4,538,364 | 9/1985 | Jensen | 406/88 X |

FOREIGN PATENT DOCUMENTS

| | | |
|---|---|---|
| 0084750 | 8/1983 | European Pat. Off. . |
| 2842828 | 4/1980 | Fed. Rep. of Germany . |
| 2115148 | 7/1972 | France . |
| 2551735 | 3/1985 | France . |

*Primary Examiner*—Kevin P. Shaver

*Attorney, Agent, or Firm*—Sandler, Greenblum & Bernstein

[57] ABSTRACT

An apparatus for guiding the movement of flowing materials, particularly in the operation of emptying grain from a silo. The apparatus of the invention is provided with a path for guiding the flow of material. The path incorporates an aperture which admits air to the path in the direction of the flowing material.

7 Claims, 1 Drawing Sheet

APPARATUS FOR CONTROLLING MATERIAL FLOW

BACKGROUND OF THE INVENTION

1. Field of the Invention

This invention relates to an apparatus for directing the flow of material, such as particulate material, and, more particularly, for emptying the contents of silos.

2. Description of Background and Relevant Materials

Various types of devices for emptying the contents of silos are known in the art. One of these is shown in European Patent 84 750, filed Dec. 17, 1982, also in the name of Applicant herein.

The apparatus which is the subject of this European patent comprises a plurality of hollow ribs situated at the bottom of a silo. These ribs have sides which form the hoppers of the apparatus; they are connected by perforated plates forming the ends of these hoppers.

Each rib has orifices opening under the perforated plates. Means are provided for sending pressurized air into the channel formed by the ribs.

This apparatus increases the flow rate of the material being emptied from the silo. However, since the ribs forming the visible bottom of the silo are subjected to very substantial pressures, they must be constructed from corrugated and arched sheet iron. Consequently, using such ribs, it is difficult to achieve an airtight seal at both the bottom of the silo and the perforated plates. These problems can be overcome, but at a substantial increase in the cost of installation.

SUMMARY OF THE INVENTION

The invention is directed to an apparatus for directing the flow of particulate material. Broadly, the apparatus comprises at least one hopper providing a path for flowing particulate material, with the hopper comprising two opposed undulating sheets defining this path therebetween.

Each undulating sheet forms a boundary between the indicated path and an air channel, and is provided with openings for allowing air to enter the path. Each undulating sheet also has a corresponding supporting surface abutting the sheet on the interior of the air channel bounded by the sheet. This supporting surface rises above the openings in its corresponding sheet, thereby preventing particulate material flowing in the indicated path from entering the air channel.

In a preferred embodiment, the apparatus of the invention includes a connecting the supporting surfaces of the indicated two opposed undulating sheets. Further, the two opposed undulating sheets, and their corresponding supporting surfaces, are inclined; in this manner, these supporting surfaces and the bed form a trapezoidal cross-section.

In this preferred embodiment, a bed of cement is situated on the base, this bed rising at least to the openings in the undulating sheets; thereby, air entering the hopper is compelled to travel in a direction substantially parallel to the direction of movement of the flowing particulate material.

The indicated openings in the undulating sheets may be provided by flaps separated and raised from the crests of the undulating sheets. Preferably, each of these flaps includes an upper first edge and a lower first edge, connected by a second edge.

The indicated upper first edge and lower first edge are parallel to one another, and extend approximately in the direction of movement of the flowing particulate material; the connecting second edge is approximately parallel to the upper first edge and lower first edge. The previously discussed cement bed, indicated to rise at least to the openings in the undulating sheets, thereby rises at least to the lower first edge.

The apparatus of the invention may comprise a plurality of such hoppers in alternating sequence with a plurality of air channels. In a preferred embodiment, the apparatus of the invention is adapted for emptying grain from silos.

DESCRIPTION OF PREFERRED EMBODIMENTS

Figure 1:
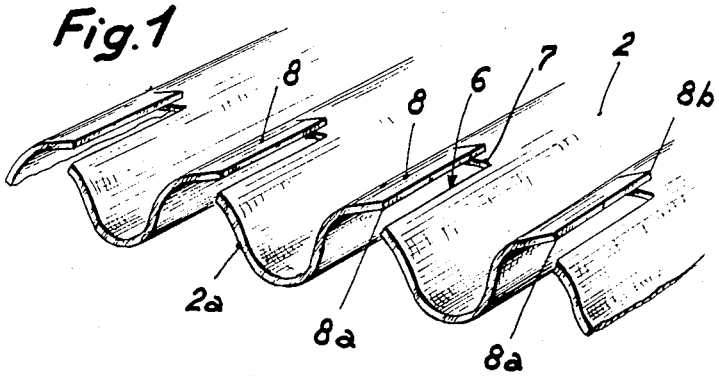
FIG. 1 is a partial perspective view of the edge of the sheet forming the tunnels of the apparatus of the invention.
Figure 2:
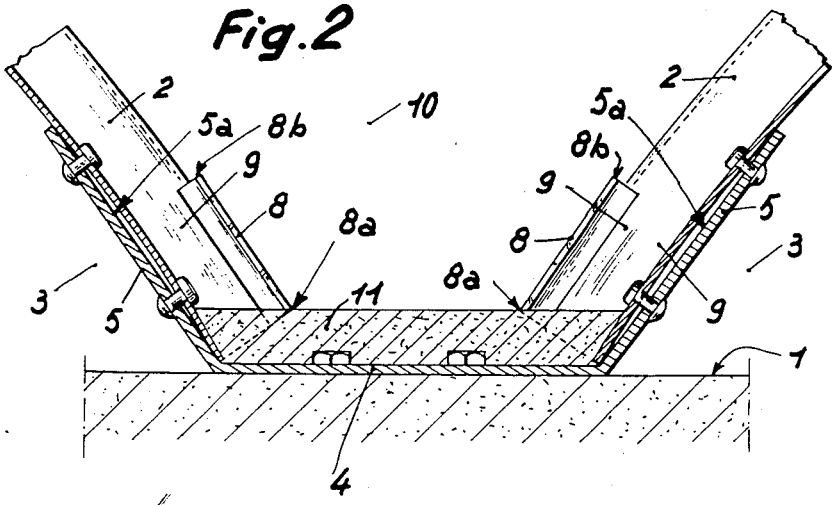
FIG. 2 is a partial transverse cross-sectional view of the apparatus of the invention.
Figure 3:
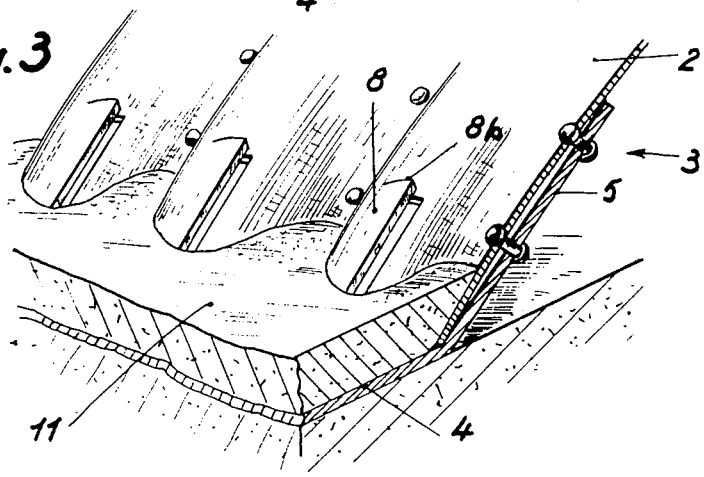
FIG. 3 is a partial perspective view of a hopper of the apparatus of the invention.

The apparatus of the invention employs ribs of a known type. The ribs are arched so as to provide tunnels with conventional hoppers situated therebetween, in a manner calculated to obtain all of the inherent advantages of this type of rib, while avoiding its disadvantages.

The ribs may be made of any suitable material, preferably iron. In a preferred embodiment, corrugated iron, particularly corrugated sheet iron, is employed.

The hoppers are provided with a base configured to provide a trapezoidal cross-section, and mounted at the bottom of the silo. The lateral wings of the base flare towards the exterior, and the internal surface of each wing is covered by the edge of the at least one tunnel formed in the corrugated sheet iron.

A portion of each tunnel is carefully cut-out to form a flap, thereby permitting air circulating under the tunnels to penetrate into the hoppers and assist the movement of grain flowing therein. A bed of cement situated on the bottom of the support provides an air-tight seal between the hoppers and the tunnels.

As shown in the drawings, tunnels 2 are mounted on bottom 1 of the silo by any conventional means. The tunnels are made of corrugated and arched sheet iron. Each tunnel defines an air channel 3 between its internal surface and bottom 1.

A base, or support, configured to form a trapezoidally shaped cross-section, is situated on bottom 1 of the silo. The support may be made of any suitable material; in a preferred embodiment, sheet metal is employed. The support has wings which flare to the exterior. Bottom 4 of the support may be mounted on silo bottom 1, or affixed thereto by any conventional means.

Edge 2*a* of each tunnel comprises two incisions formed therein. The first of these, incision 6, extends parallel to the undulations of the corrugated sheet iron. Second incision 7 is perpendicular to first incision 6, and extends substantially to the apex of the corresponding undulation. As seen in FIG. 1, this cut-away portion of the tunnel is raised to form flap 8.

Lateral portion 9 of each tunnel is attached, by any conventional means, to internal surface 5*a* of wing 5 of the support.

To prevent the air circulating in channels 3 from entering hoppers 10 in a direction perpendicular to the axis of the hoppers, cement bed 11, or any suitable equivalent, is positioned on bottom 4 of the support. Cement bed 11 extends from bottom 4 at least to lower angle 8*a* of flap 8.

The positioning of the openings formed by flaps 8 causes the air circulating in channels 3 to enter hoppers 10 in a direction substantially parallel to the axis of said hoppers.

With respect to bottom 1 of the silo, wings 5 are of sufficient height so as to extend well above upper angle 8*b* of flaps 8. Accordingly, flaps 8 can be of sufficient length to provide air apertures of relatively substantial cross-section, without risking penetration of the grain into channel 3.

Although the flow-directing apparatus of the invention is discussed primarily with regard to its utility for emptying silos, it is to be understood that the apparatus may be used in any setting to guide the movement of any flowing material, especially particulate material.

It is further understood that although the invention has been specifically described with reference to particular means and embodiments, the foregoing description is that of preferred embodiments of the invention, and the invention is not limited to the particulars disclosed, but extends to all equivalents, and various changes and modifications may be made in the invention without departing from the spirit and scope thereof.

What is claimed is:

1. An apparatus for directing the flow of particulate material, comprising:

(a) at least one hopper providing a path for flowing particulate material, said at least one hopper comprising two opposed undulating sheets defining said path therebetween, each undulating sheet:

(1) forming a boundary between said path and an air channel; and (2) having openings therein for allowing air to enter said path; and (b) a supporting surface corresponding to each of said undulating sheets, each supporting surface:

(1) abutting its corresponding undulating sheet on the interior of the air channel bounded by said undulating sheet; and (2) rising above the openings in its corresponding undulating sheet, thereby preventing particulate material flowing in said path from entering said air channel.

2. The apparatus as defined by claim 1 adapted for emptying grain from silos.

3. The apparatus as defined by claim 2 wherein said at least one hopper comprises a plurality of hoppers, said hoppers being located side-by-side with said air channels disposed therebetween.

4. The apparatus as defined by claim 1 further comprising:

(a) a base connecting the supporting surfaces of said two opposed undulating sheets, with said two opposed undulating sheets, and their corresponding supporting surfaces, being inclined, so that said corresponding supporting surfaces and said base form a trapezoidal cross-section; and (b) a bed of cement situated on said base, and rising at least to said openings, thereby compelling air entering said hopper to travel in a direction substantially parallel to the direction of movement of said flowing particulate material.

5. The apparatus as defined by claim 4 adapted for emptying grain from silos.

6. The apparatus as defined by claim 4 wherein said openings are provided by flaps separated and raised from the crests of said undulating sheets.

7. The apparatus as defined by claim 6 wherein each of said flaps comprises:

(a) an upper first edge and a lower first edge, said upper first edge and said lower first edge being parallel to one another, and extending approximately in the direction of movement of said flowing particulate material; and (b) a second edge connecting and approximately perpendicular to said upper first edge and said lower first edge;

whereby said cement bed rises at least to said lower first edge.

* * * * *